US011089422B2

(12) United States Patent
Suyama et al.

(10) Patent No.: US 11,089,422 B2
(45) Date of Patent: Aug. 10, 2021

(54) SOUND SIGNAL PROCESSOR AND SOUND SIGNAL PROCESSING METHOD

(71) Applicant: YAMAHA CORPORATION, Hamamatsu (JP)

(72) Inventors: Akihiko Suyama, Hamamatsu (JP); Ryotaro Aoki, Hamamatsu (JP); Tatsuya Fukuyama, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/837,494

(22) Filed: Apr. 1, 2020

(65) Prior Publication Data

US 2020/0322744 A1 Oct. 8, 2020

(30) Foreign Application Priority Data

Apr. 3, 2019 (JP) ..... JP2019-071009

(51) Int. Cl.
*H04S 7/00* (2006.01)

(52) U.S. Cl.
CPC ..... *H04S 7/30* (2013.01)

(58) Field of Classification Search
CPC ..... H04S 7/30
See application file for complete search history.

(56) References Cited

U.S. PATENT DOCUMENTS 5,406,022 A 4/1995 Kobayashi
5,422,430 A 6/1995 Ikeya
9,942,688 B2 4/2018 Robinson
2006/0133628 A1* 6/2006 Trivi ..... G10H 1/0066 381/310
2007/0080392 A1 4/2007 Tomiye
(Continued)

FOREIGN PATENT DOCUMENTS

EP 2485218 A2 8/2012
JP H07230283 A 8/1995
JP 2007103456 A 4/2007
(Continued)

OTHER PUBLICATIONS

Extended European Search Report issued in European Appln. No. 20167568.3 dated Jul. 3, 2020.
(Continued)

*Primary Examiner* — Fan S Tsang
*Assistant Examiner* — Daniel R Sellers
(74) *Attorney, Agent, or Firm* — Rossi, Kimms & McDowell LLP

(57) ABSTRACT

A sound signal processor includes a memory storing instructions and a processor configured to implement the stored instructions to execute a plurality of tasks, the tasks including a receiving task configured to receive audio information, a sound source position setting task configured to set position information of a sound source based on the received audio information, and a sound image localization processing task configured to calculate an output level of a sound signal of the sound source for a plurality of speakers to thereby perform sound image localization processing of the sound source to localize a sound image of the sound source in a sound image localization position based on the set position information.

19 Claims, 7 Drawing Sheets

(56) References Cited

U.S. PATENT DOCUMENTS

2009/0177479 A1* 7/2009 Yoon ..... G10L 19/008
704/500
2011/0252950 A1 10/2011 Trivi

FOREIGN PATENT DOCUMENTS

WO 2013006338 A2 1/2013
WO WO-2014087277 A1 * 6/2014 ..... H04S 7/30

OTHER PUBLICATIONS

Office Action issued in Chinese Appln. No. 202010216221.8 dated Mar. 3, 2021. English machine translation provided.

* cited by examiner

SOUND SIGNAL PROCESSOR AND SOUND SIGNAL PROCESSING METHOD

CROSS REFERENCE TO RELATED APPLICATION

This application is based upon and claims the benefit of priority of Japanese Patent Application No. 2019-071009 filed on Apr. 3, 2019, the contents of which are incorporated herein by reference in its entirety.

BACKGROUND OF THE INVENTION

1. Field of the Invention

An embodiment of this invention relates to a sound signal processor that performs various processing on a sound signal.

2. Description of the Related Art

JP-A-2007-103456 discloses an electronic musical instrument that realizes a sound image with a depth like a grand piano.

The related electronic musical instrument realizes a musical expression of an existing acoustic musical instrument. Therefore, in the related electronic musical instrument, the sound image localization position of the sound source is fixed.

SUMMARY OF THE INVENTION

Accordingly, an object of this invention is to provide a sound signal processor capable of realizing a non-conventional new musical expression.

A sound signal processor according to an aspect of this invention includes a memory storing instructions and a processor configured to implement the stored instructions to execute a plurality of tasks, the tasks including a receiving task configured to receive audio information, a sound source position setting task configured to set position information of a sound source based on the received audio information, and a sound image localization processing task configured to calculate an output level of a sound signal of the sound source for a plurality of speakers to thereby perform sound image localization processing of the sound source to localize a sound image of the sound source in a sound image localization position based on the set position information.

According to the aspect of this invention, a non-conventional new musical expression can be realized.

DETAILED DESCRIPTION OF THE EXEMPLARY EMBODIMENTS

Figure 1:
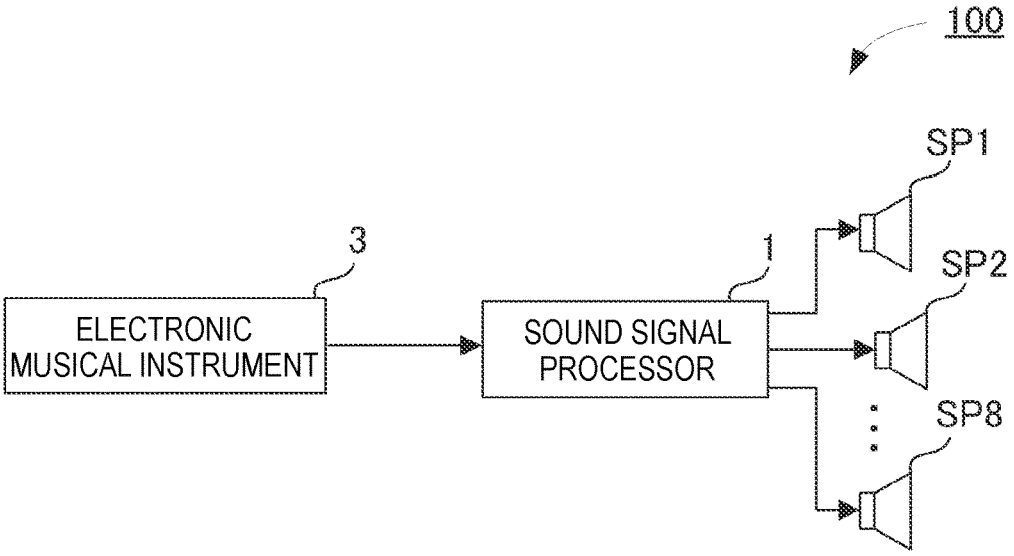
FIG. 1 is a block diagram showing the structure of a sound signal processing system.

FIG. 1 is a block diagram showing the structure of a sound signal processing system. The sound signal processing system 100 is provided with: a sound signal processor 1, an electronic musical instrument 3 and a plurality of speakers (in this example, eight speakers) SP1 to SP8.

The sound signal processor 1 is, for example, a personal computer, a set-top box, an audio receiver or a power amplifier. The sound signal processor 1 receives audio information including pitch information from the electronic musical instrument 3. In the present embodiment, if not specifically mentioned, the sound signal means a digital signal.

Figure 2:
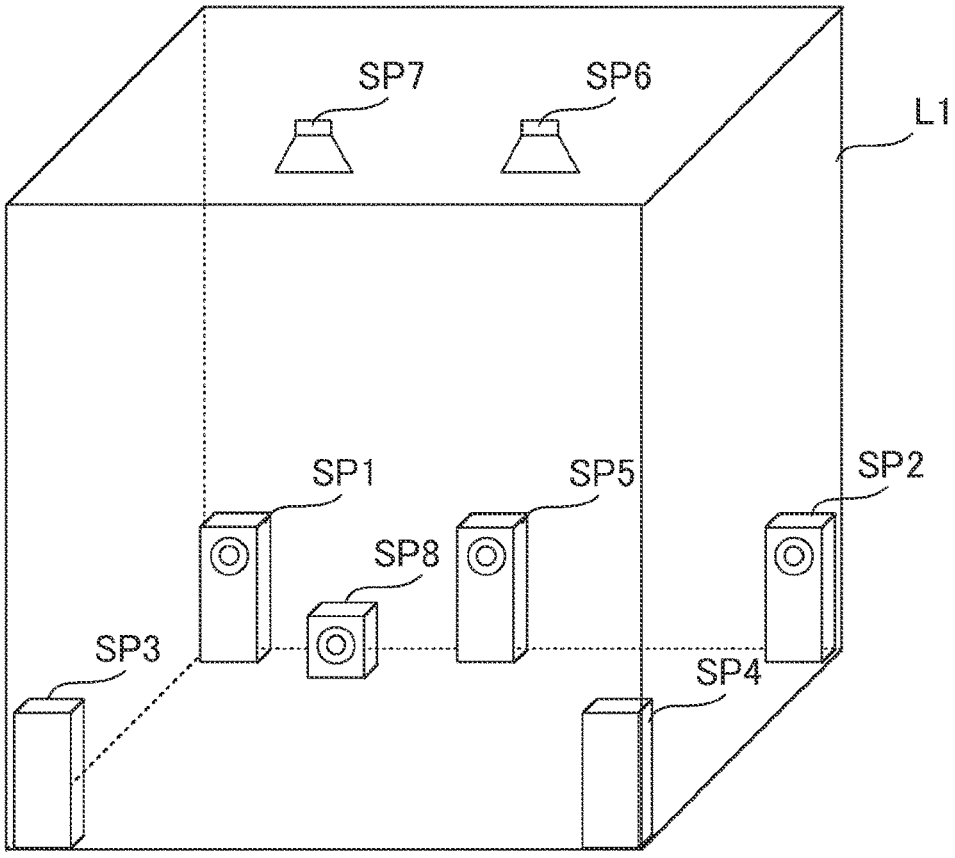
FIG. 2 is a perspective view schematically showing a room L1 as a listening environment.

As shown in FIG. 2, the speakers SP1 to SP8 are placed in a room L1. In this example, the shape of the room is a rectangular parallelepiped. For example, the speaker SP1, the speaker SP2, the speaker SP3 and the speaker SP4 are placed in the four corners of the floor of the room L1. The speaker SP5 is placed on one of the side surfaces of the room L1 (in this example, the front). The speaker SP6 and the speaker SP7 are placed on the ceiling of the room L1. The speaker SP8 is a subwoofer which is placed, for example, near the speaker SP5.

The sound signal processor 1 performs sound image localization processing to localize a sound image of a sound source in a predetermined position by distributing the sound signal of the sound source to these speakers with a predetermined gain and with a predetermined delay time.

Figure 3:
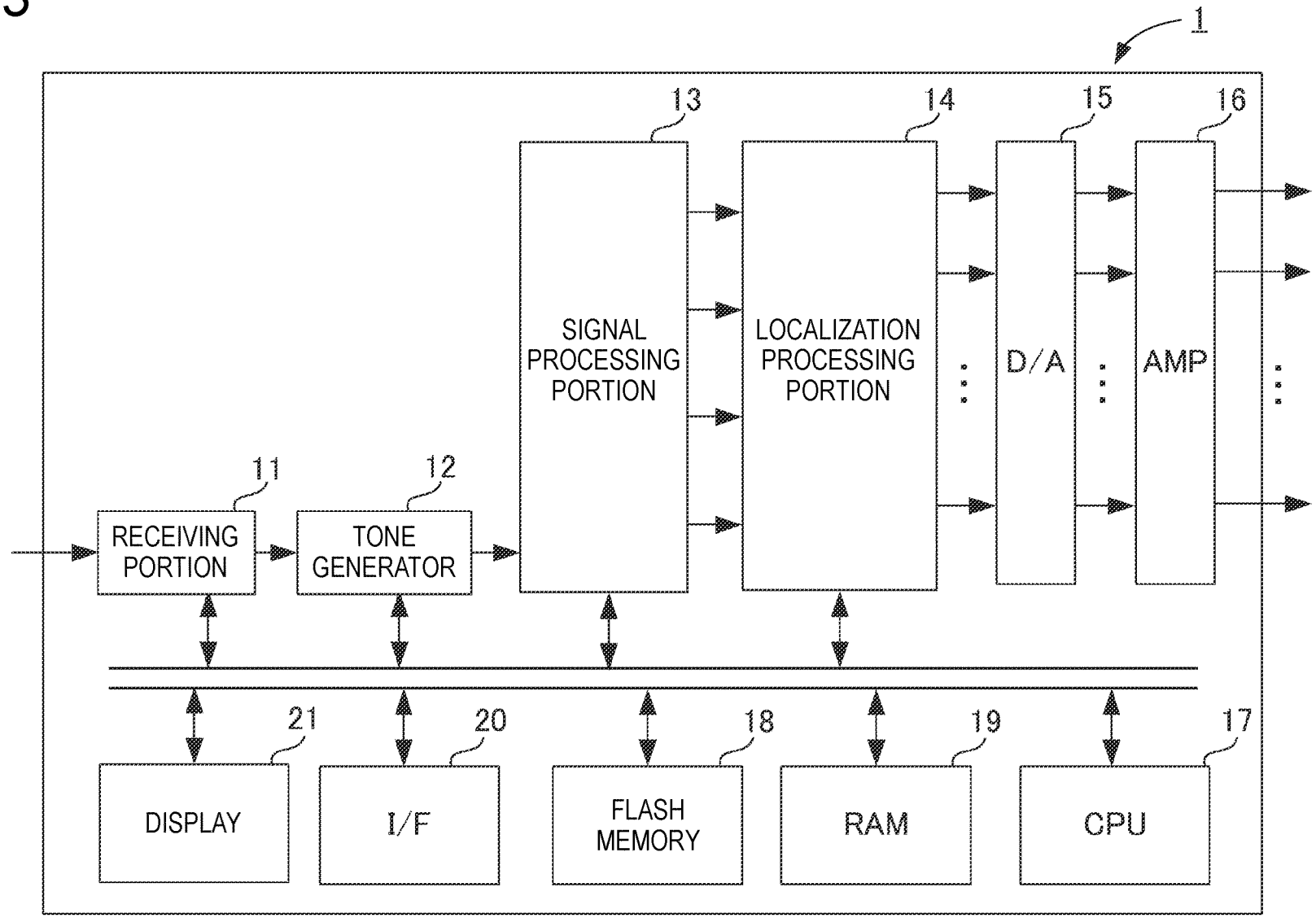
FIG. 3 is a block diagram showing the structure of a sound signal processor 1.

As shown in FIG. 3, the sound signal processor 1 includes a receiving portion 11, a tone generator 12, a signal processing portion 13, a localization processing portion 14, a D/A converter 15, an amplifier (AMP) 16, a CPU 17, a flash memory 18, a RAM 19, an interface (I/F) 20 and a display 21.

The CPU 17 reads an operation program (firmware) stored in the flash memory 18 to the RAM 19, and integrally controls the sound signal processor 1.

The receiving portion 11 is a communication interface such as an HDMI (trademark), a MIDI or a LAN. The receiving portion 11 receives audio information (input information) from the electronic musical instrument 3. For example, according to the MIDI standard, the audio information includes a note-on message and a note-off message. The note-on message and the note-off message include information representative of the tone (track number), pitch information (note number) and information related to the sound strength (velocity). Moreover, the audio information may include a temporal parameter such as attack, decay or sustain.

The CPU 17 drives the tone generator 12 and generates a sound signal based on the audio information received by the receiving portion 11. The tone generator 12 generates, with the tone specified by the audio information, a sound signal of the specified pitch with the specified level.

The signal processing portion 13 is configured by, for example, a DSP. The signal processing portion 13 receives the sound signals generated by the tone generator 12. The signal processing portion 13 assigns each of the sound signals to the channels of objects respectively, and performs predetermined signal processing such as delay, reverb or equalizer for each of the channels.

The localization processing portion 14 is configured by, for example, a DSP. The localization processing portion 14 performs sound image localization processing according to an instruction of the CPU 17. The localization processing portion 14 distributes the sound signals of the sound sources to the speakers SP1 to SP8 with a predetermined gain so that the sound images are localized in positions corresponding to the position information of the sound sources specified by the CPU 17. The localization processing portion 14 inputs the sound signals for the speakers SP1 to SP8 to the D/A converter 15.

The D/A converter 15 converts the sound signals into analog signals. The AMP 16 amplifies the analog signals and inputs them to the speakers SP1 to SP8.

The signal processing portion 13 and the localization processing portion 14 may be implemented by individual DSPs by means of hardware or may be implemented in one DSP by means of software. Moreover, it is not essential that the D/A converter 15 and the AMP 16 be incorporated in the sound signal processor 1. For example, the sound signal processor 1 outputs the digital signals to another device incorporating a D/A converter and an amplifier.

Figure 4:
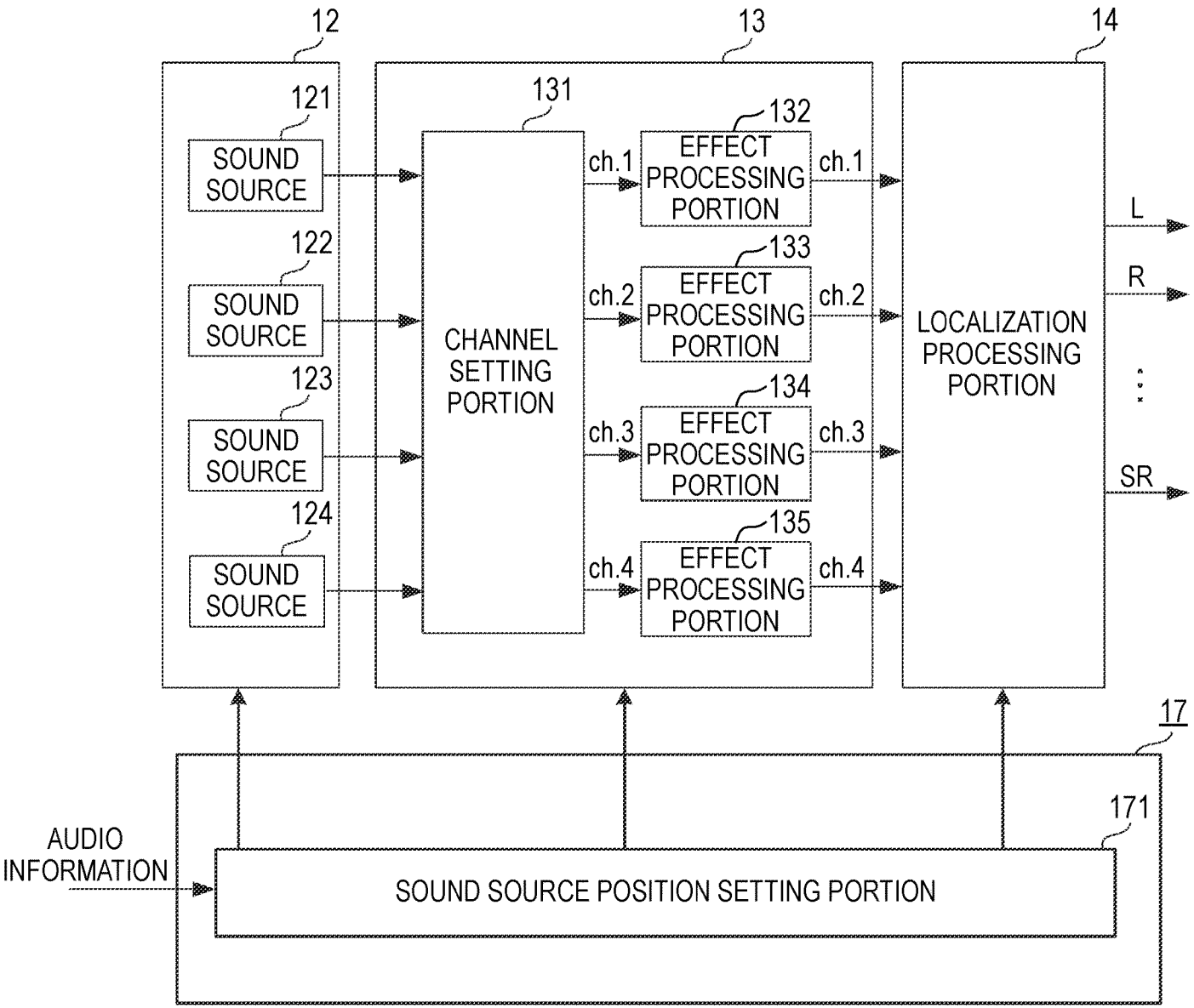
FIG. 4 is a block diagram showing the functional structure of a tone generator 12, a signal processing portion 13 and a CPU 17.
Figure 5:
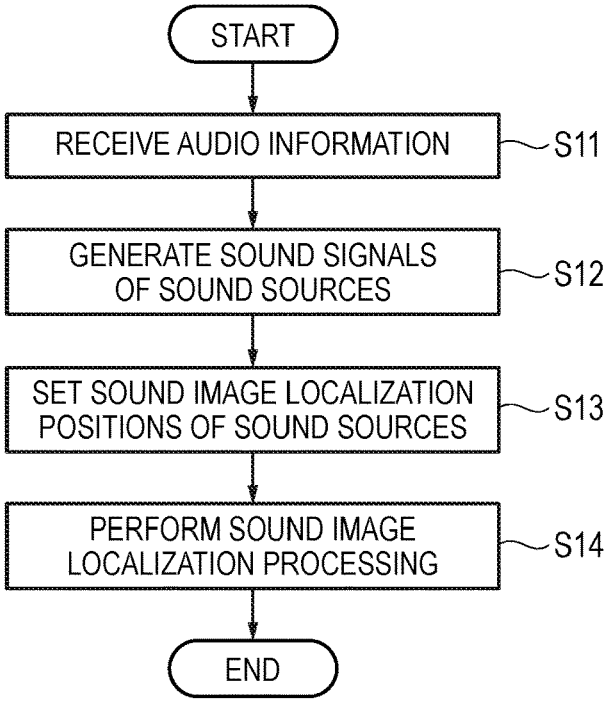
FIG. 5 is a flowchart showing an operation of the sound signal processor 1.

FIG. 4 is a block diagram showing the functional structure of the tone generator 12, the signal processing portion 13 and the CPU 17. These functions are implemented, for example, by a program. FIG. 5 is a flowchart showing an operation of the sound signal processor 1.

The CPU 17 receives audio information such as a note-on message or a note-off message through the receiving portion 11 (S11). The CPU 17 drives the sound sources of the tone generator 12 and generates sound signals based on the audio information received by the receiving portion 11 (S12).

The tone generator 12 functionally includes a sound source 121, a sound source 122, a sound source 123 and a sound source 124. In this example, the tone generator 12 functionally includes four sound sources. The sound sources 121 to 124 each generate a sound signal of a specified tone and a specified pitch with a specified level.

The signal processing portion 13 functionally includes a channel setting portion 131, an effect processing portion 132, an effect processing portion 133, an effect processing portion 134 and an effect processing portion 135. The channel setting portion 131 assigns the sound signal inputted from each sound source to the channel of each object. In this example, four object channels are present. Accordingly, the signal processing portion 13, for example, assigns the sound signal of the sound source 121 to the effect processing portion 132 of a first channel, assigns the sound signal of the sound source 122 to the effect processing portion 133 of a second channel, assigns the sound signal of the sound source 123 to the effect processing portion 134 of a third channel, and assigns the sound signal of the sound source 124 to the effect processing portion 135 of a fourth channel. Needless to say, the number of sound sources and the number of object channels are not limited to this example; they may be larger or may be smaller.

The effect processing portions 132 to 135 perform predetermined processing such as delay, reverb or equalizer on the inputted sound signals.

The CPU 17 functionally includes a sound source position setting portion 171. The sound source position setting portion 171 associates each sound source with the position information of the sound source and sets the sound image localization position of each sound source based on the audio information received by the receiving portion 11 (S14). The sound source position setting portion 171 sets the position information of each sound source, for example, so that the sound image is localized in a different position for each tone, each pitch or each sound strength. Moreover, the sound source position setting portion 171 may set the position information of the sound source based on the order of sound emission (the order in which audio information is received by the receiving portion 11). Moreover, the sound source position setting portion 171 may set the position information of the sound source in a random fashion. Alternatively, in a case where a plurality of electronic musical instruments are connected to the sound signal processor 1, the sound source position setting portion 171 may set the position information of the sound source for each electronic musical instrument.

The localization processing portion 14 distributes the sound signal of each object channel to the speakers SP1 to SP8 with a predetermined gain so that the sound image is localized in a position corresponding to the sound source position set by the sound source position setting portion 171 of the CPU 17 (S15).

In the related electronic musical instrument as described in JP-A-2007-103456, the sound image localization position of the sound source is set in the position of the sound source generated when a grand piano is played. That is, in the related electronic musical instrument, the sound image localization position of the sound source is uniquely set according to the pitch. However, in the sound signal processor 1 of the present embodiment, the sound image localization position of the sound source is not uniquely set according to the pitch. Thereby, the sound signal processor 1 of the present embodiment is capable of realizing a non-conventional new musical expression.

Figure 6:
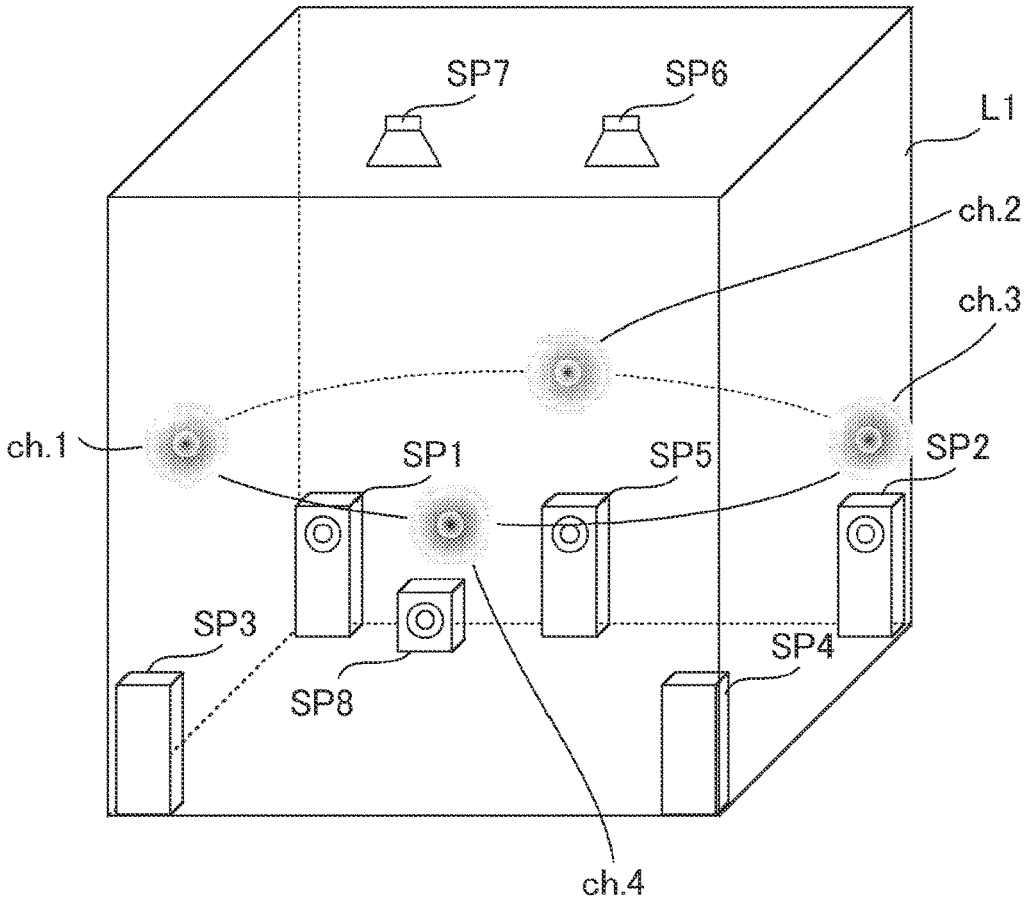
FIG. 6 is a perspective view schematically showing the relation between the room L1 and sound image localization positions.

FIG. 6 is a perspective view schematically showing the relation between the room L1 and the sound image localization positions. The sound source position setting portion 171 sets the sound image localization position of the sound source related to the first channel on the left side of the room. The sound source position setting portion 171 sets the sound image localization position of the sound source related to the second channel in the front of the room. The sound source position setting portion 171 sets the sound image localization position of the sound source related to the third channel on the right side of the room. The sound source position setting portion 171 sets the sound image localization position of the sound source related to the fourth channel in the rear of the room. That is, in the example of FIG. 6, the sound image localization position is set for each sound source.

Figure 7:
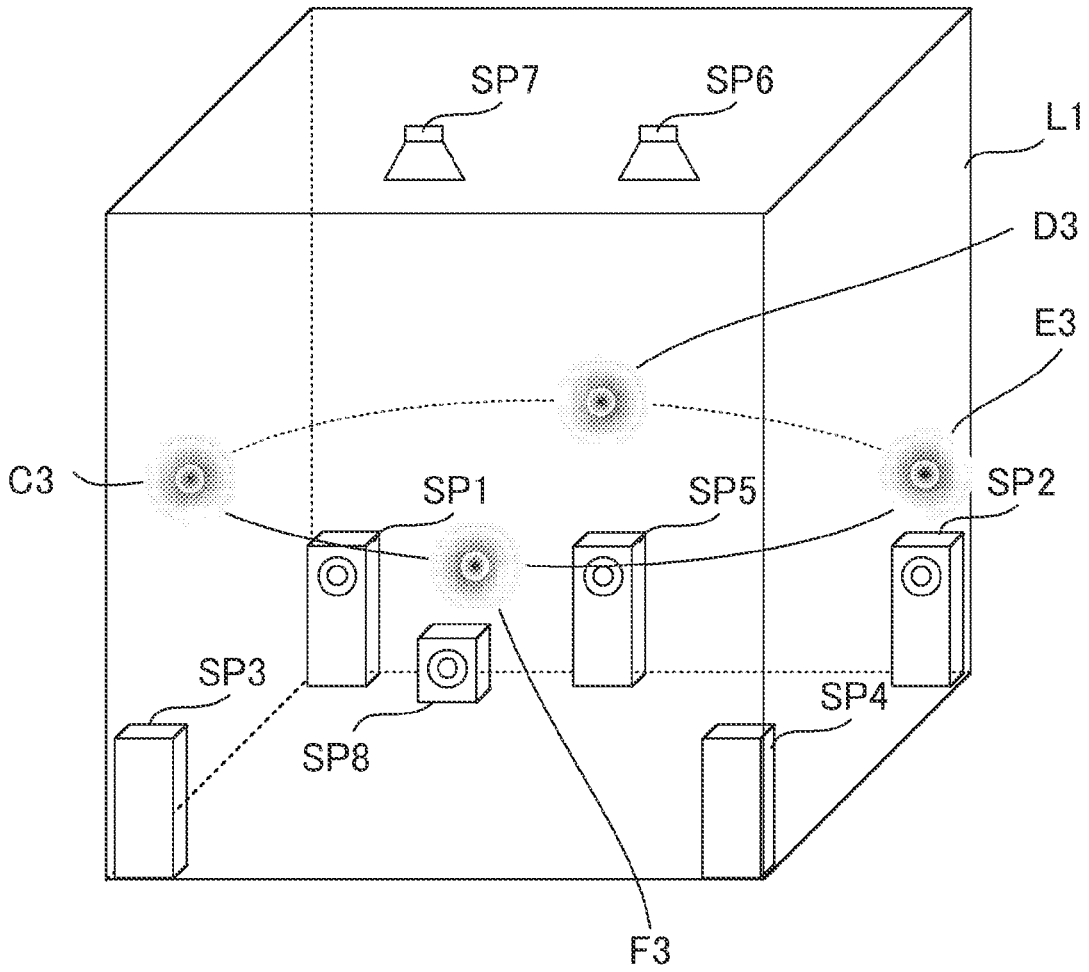
FIG. 7 is a perspective view schematically showing the relation between the room L1 and sound image localization positions.

In the example of FIG. 7, the sound signal processor 1 sets a different sound image localization position for each pitch. In this example, the sound signal processor 1 sequentially inputs four pieces of audio information, that is, pieces of pitch information C3, D3 and E3 and F3 with the same track number from the electronic musical instrument 3. Normally, the CPU 17 selects the same sound source for pieces of audio information of the same track number. However, for the first pitch information C3, the sound source position setting portion 171 selects the sound source 121 corresponding to the first channel irrespective of the track number. Thereby, the sound signal of the sound source related to the pitch information C3 is localized on the left side of the room.

For the next pitch information D3, the sound source position setting portion 171 selects the sound source 122 corresponding to the second channel irrespective of the track number. Thereby, the sound signal of the sound source related to the pitch information D3 is localized in the front of the room. For the next pitch information D4, the sound source position setting portion 171 selects the sound source 123 corresponding to the third channel irrespective of the track number. Thereby, the sound signal of the sound source related to the pitch information E3 is localized on the right side of the room. For the next pitch information F3, the sound source position setting portion 171 selects the sound source 124 corresponding to the fourth channel irrespective of the track number. Thereby, the sound signal of the sound source related to the pitch information D3 is localized in the rear of the room.

As described above, the sound signal processor 1 is capable of realizing a new musical expression by changing the sound image localization position of the sound source according to the pitch.

The sound source position setting portion 171 may change the object channel associated with each sound source without changing the selected sound source according to the specified track number. For example, in a case where the four pieces of audio information, that is, pieces of pitch information C3, D3, E3 and F3 are sequentially inputted with the same track number, for the first pitch information C3, the sound source position setting portion 171 associates the sound source 121 with the first channel. For the next pitch information D3, the sound source position setting portion 171 associates the sound source 121 with the second channel. For the next pitch information E3, the sound source position setting portion 171 associates the sound source 121 with the third channel. For the next pitch information F3, the sound source position setting portion 171 associates the sound source 121 with the fourth channel. In this case, sound image localization similar to that of the example shown in FIG. 7 can be realized, and the sound signal of the sound source corresponding to the specified track number is generated.

Alternatively, the sound source position setting portion 171 may change the position information outputted to the localization processing portion 14. For example, in a case where four pieces of audio information, that is, pieces of pitch information C3, D3, E3 and F4 are sequentially inputted with the same track number, for the pitch information D3, although associating the sound source 121 with the first channel, the sound source position setting portion 171 sets the position information, outputted to the localization processing portion 14, so as to be localized in the front of the room. Likewise, for the pitch information E3, although associating the sound source 121 with the first channel, the sound source position setting portion 171 sets the position information, outputted to the localization processing portion 14, so as to be localized on the right side of the room. For the pitch information F3, although associating the sound source 121 with the first channel, the sound source position setting portion 171 sets the position information, outputted to the localization processing portion 14, so as to be localized in the rear of the room. In this case also, sound image localization similar to that in the example shown in FIG. 7 can be realized, and the sound signal of the sound source corresponding to the specified track number is generated.

Figure 8:
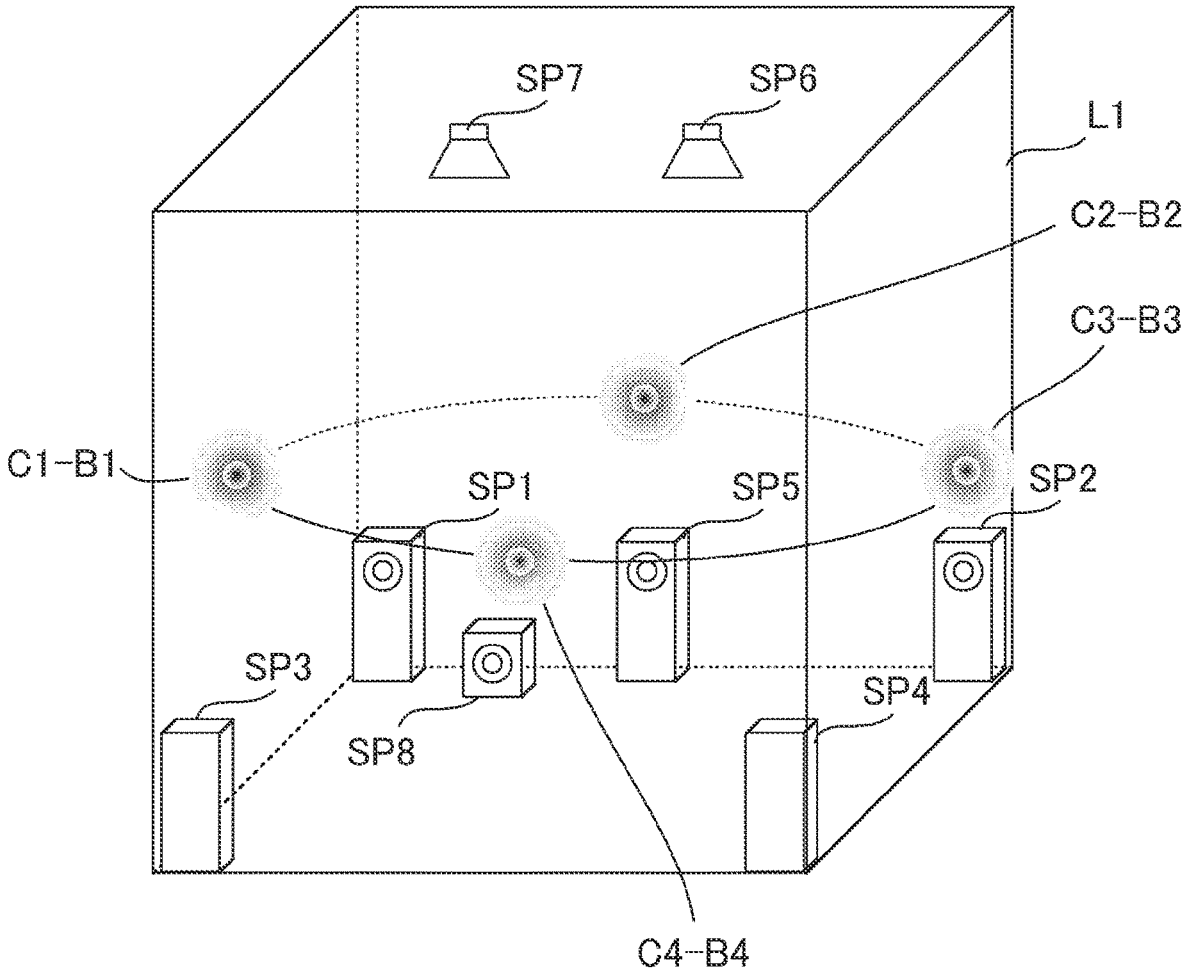
FIG. 8 is a perspective view schematically showing the relation between the room L1 and sound image localization positions.

Additionally, as described above, the sound source position setting portion 171 may set the position information of the sound source, for example, for each tone, for each pitch, for each sound strength, in the order of sound emission or randomly. Moreover, the sound source position setting portion 171 may set the position information of the sound source for each octave as shown in FIG. 8. In the example of FIG. 8, the sound source position setting portion 171 localizes the sound image of the octave between C1 and B1 on the left side of the room. The sound source position setting portion 171 localizes the sound image of the octave between C2 and B2 in the front of the room on the ceiling side. The sound source position setting portion 171 localizes the sound image of the octave between C3 and B3 on the right side of the room. The sound source position setting portion 171 localizes the sound image of the octave between C4 and B4 in the rear of the room on the floor side.

Alternatively, the sound source position setting portion 171 may set the position information of the sound source for each chord. For example, the sound source position setting portion 171 may localize the sound image of a major chord on the left side of the room, localize the sound image of a minor chord in the front of the room and localize the sound image of a seventh chord on the right side of the room. Further, even for the same chords, the position information of the sound source may be set according to the order of emission of single tones constituting each chord. For example, the sound source position setting portion 171 may change the sound source position between in a case where the audio information is received in the order of C3, E3 and G3 and in a case where the audio information is received in order of G3, E3 and C3. Moreover, the sound source position may be changed in a case where the same pitch (for example, C1) is continuously inputted not less than a predetermined number of times.

The above-described embodiment shows examples in all of which the sound image localization position is changed on a two-dimensional plane. However, the sound source position setting portion 171 may set the sound source position based on a coordinate on one dimension using two speakers. Moreover, the sound source position setting portion 171 may set the sound source position based on three-dimensional coordinates.

Figure 9:
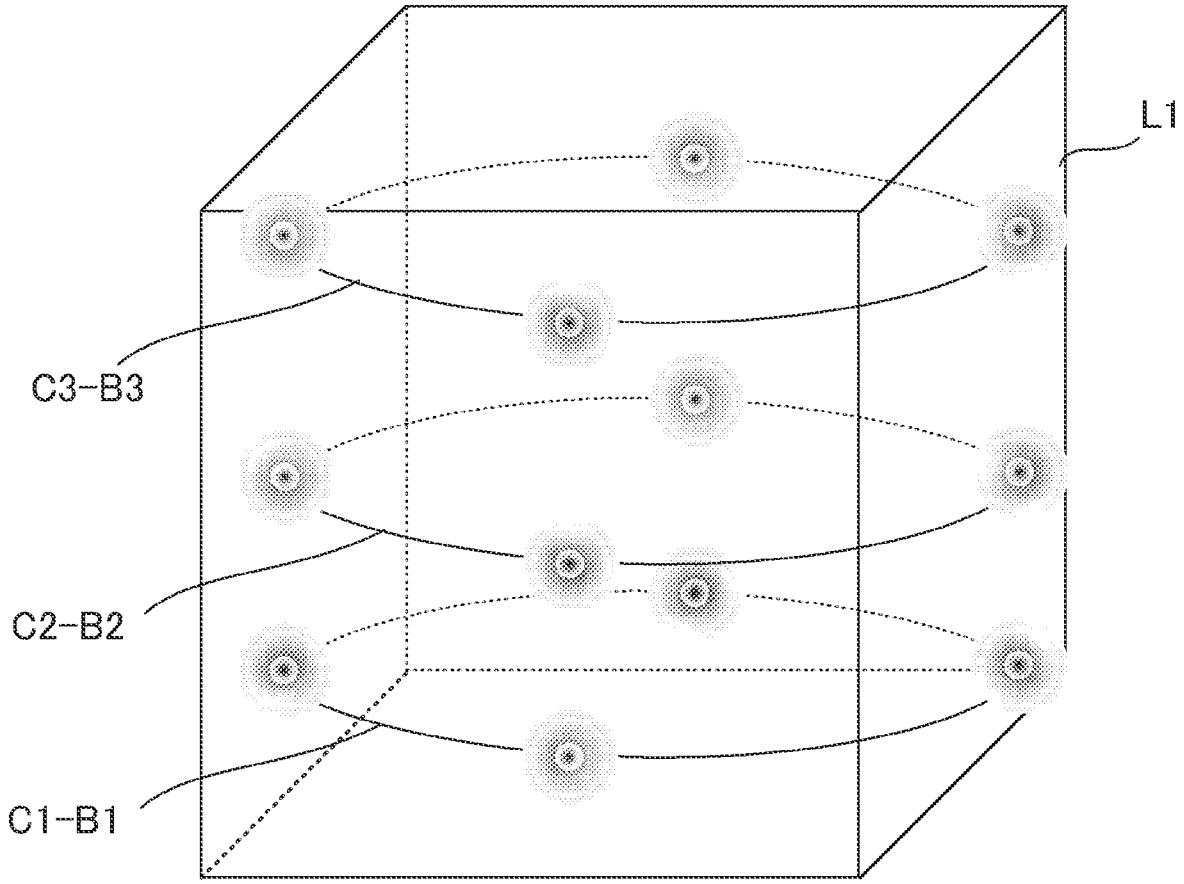
FIG. 9 is a perspective view schematically showing the relation between the room L1 and sound image localization positions.

For example, as shown in FIG. 9, the sound source position setting portion 171 localizes sound sources on a predetermined circle for each octave, and localizes low pitch sounds in low positions and high pitch sounds in high positions. Alternatively, the sound source position setting portion 171 may localize weak sounds in low positions and strong sounds in high positions according to the sound strength.

The descriptions of the present embodiment are illustrative in all respects and not restrictive. The scope of the present invention is shown not by the above-described embodiment but by the scope of the claims. Further, it is intended that all changes within the meaning and the scope equivalent to the scope of the claims are embraced by the scope of the present invention.

For example, the above-described embodiment shows an example in which the sound signal processor 1 includes a tone generator that generates a sound signal. However, the sound signal processor 1 may receive a sound signal from the electronic musical instrument 3 and receive audio information corresponding to the sound signal. In this case, it is not necessary for the sound signal processor 1 to be provided with a tone generator. Alternatively, the tone generator may be incorporated in another device completely different from the sound signal processor 1 and the electronic musical instrument 3. In this case, the electronic musical instrument 3 transmits audio information to a sound source device incorporating a tone generator. Moreover, the electronic musical instrument 3 transmits audio information to the sound signal processor 1. The sound signal processor 1 receives a sound signal from the sound source device, and receives audio information from the electronic musical instrument 3. Moreover, the sound signal processor 1 may be provided with the function of the electronic musical instrument 3.

The above-described embodiment shows an example in which the sound signal processor 1 receives a digital signal from the electronic musical instrument 3. However, the sound signal processor 1 may receive an analog signal from the electronic musical instrument 3. In this case, the sound signal processor 1 identifies the audio information by analyzing the received analog signal. For example, the sound signal processor 1 can identify information equal to a note-on message by detecting the timing when the level of the analog signal abruptly increases and detecting the timing of the attack. Moreover, the sound signal processor 1 can identify pitch information by using a known pitch analysis technology from the analog signal. In this case, the receiving portion 11 receives audio information such as the pitch information identified by the own device.

Moreover, the sound signal is not limited to the example in which it is received from the electronic musical instrument. For example, the sound signal processor 1 may receive an analog signal from a musical instrument that outputs an analog signal such as an electronic guitar. Moreover, the sound signal processor 1 may collect the sound of an acoustic instrument with a microphone and receive the analog signal obtained by the microphone. In this case also, the sound signal processor 1 can identify audio information by analyzing the analog signal.

Moreover, for example, the sound signal processor 1 may receive the sound signal of each sound source through an audio signal input terminal and receive audio information through a network interface (network I/F). That is, the sound signal processor 1 may receive the sound signal and the audio information through different communication portions, respectively.

Moreover, the electronic musical instrument 3 may be provided with the sound source position setting portion 171 and the localization processing portion 14. In this case, a plurality of speakers are connected to the electronic musical instrument 3. Accordingly, in this case, the electronic musical instrument 3 corresponds to the sound signal processor of the present invention. Moreover, the device that outputs audio information is not limited to the electronic musical instrument. For example, the user may use a keyboard for a personal computer or the like instead of the electronic musical instrument 3 to input a note number, a velocity or the like to the sound signal processor 1.

Moreover, the structure of the sound signal processor 1 is not limited to the above-described structure; for example, it may have a structure having no amplifier. In this case, the output signal from the D/A converter is outputted to an external amplifier or to a speaker incorporating an amplifier.

What is claimed is:

1. A sound signal processor comprising:

a memory storing instructions; and a processor configured to implement the stored instructions to execute a plurality of tasks, including:

a receiving task configured to receive audio information;

a sound source position setting task configured to set position information of a sound source based on the received audio information; and a sound image localization processing task configured to calculate an output level of a sound signal of the sound source for a plurality of speakers to thereby perform sound image localization processing of the sound source to localize a sound image of the sound source in a sound image localization position based on the set position information, wherein the plurality of tasks executed by the processor further include another receiving task configured to receive the sound signal of the sound source;

wherein the receiving task receives the audio information through a first communication portion;

wherein the another receiving task receives the sound signal of the sound source through a second communication portion which is different from the first communication portion;

wherein the first communication portion is a network interface which is connectable to a network; and wherein the receiving task receives the audio information through the network interface from the network.

2. The sound signal processor according to claim 1, wherein the sound source position setting task sets the position information of the sound source based on three-dimensional coordinates.

3. The sound signal processor according to claim 1, wherein the audio information includes information related to a sound strength; and wherein the sound source position setting task sets the position information of the sound source based on the information related to the sound strength.

4. The sound signal processor according to claim 1, wherein the sound source position setting task sets the position information of the sound source based on an order in which the audio information is received.

5. The sound signal processor according to claim 1, wherein the audio information includes track information of the sound source; and wherein the sound source position setting task sets the position information of the sound source based on the track information.

6. The sound signal processor according to claim 1, wherein the received audio information includes audio information of a plurality of sound sources; and wherein the sound image localization processing task receives a different sound signal for each sound source of the plurality of sound sources, and performs the sound image localization processing by using the different sound signals to localize sound images of the plurality of sound sources in different sound image localization positions.

7. The sound signal processor according to claim 1, wherein the audio information includes pitch information.

8. The sound signal processor according to claim 1, wherein the sound source position setting task is configured to set the position information of the sound source based on kinds of chords included in the received audio information.

9. The sound signal processor according to claim 8, wherein the kinds of chords include a major chord, a minor chord, and a seventh chord.

10. A sound signal processing method comprising:

receiving audio information;

setting position information of a sound source based on the received audio information;

calculating an output level of a sound signal of the sound source for a plurality of speakers to thereby perform sound image localization processing of the sound source to localize a sound image of the sound source in a sound image localization position based on the set position information; and receiving the sound signal of the sound source, wherein the audio information is received through a first communication portion, and the sound signal of the sound source is received through a second communication portion which is different from the first communication portion;

wherein the first communication portion is a network interface which is connectable to a network; and wherein in the receiving of the audio information, the audio information is received through the network interface from the network.

11. The sound signal processing method according to claim 10, wherein the position information of the sound source is set based on three-dimensional coordinates.

12. The sound signal processing method according to claim 10, wherein the audio information includes information related to a sound strength; and wherein the position information of the sound source is set based on the information related to the sound strength.

13. The sound signal processing method according to claim 10, wherein the position information of the sound source is set based on an order in which the audio information is received.

14. The sound signal processing method according to claim 10, wherein the audio information includes track information of the sound source; and wherein the position information of the sound source is set based on the track information.

15. The sound signal processing method according to claim 10, wherein the received audio information includes audio information of a plurality of sound sources; and wherein a different sound signal is received for each sound source of the plurality of sound sources, and the sound image localization processing is performed by using the different sound signals to localize sound images of the plurality of sound sources in different sound image localization positions.

16. The sound signal processing method according to claim 10, wherein the position information of the sound source is set based on kinds of chords included in the received audio information.

17. The sound signal processing method according to claim 16, wherein the kinds of chords include a major chord, a minor chord, and a seventh chord.

18. The sound signal processing method according to claim 10, wherein the audio information includes pitch information.

19. An apparatus, comprising:

a first interface configured to receive and to output audio information;

one or more digital signal processors configured to receive the audio information from the first interface and to:

set position information of a sound source based on the received audio information; and calculate an output level of a sound signal of the sound source for a plurality of speakers to thereby perform sound image localization processing of the sound source to localize a sound image of the sound source in a sound image localization position based on the set position information; and a second interface configured to receive the sound signal of the sound source, wherein the audio information is received through the first interface and the sound signal of the sound source is received through the second interface which is different from the first interface;

wherein the first interface is a network interface which is connectable to a network; and wherein the audio information is received through the network interface from the network.

* * * * *